US008204402B2

(12) United States Patent
Yoshizawa et al.

(10) Patent No.: US 8,204,402 B2
(45) Date of Patent: Jun. 19, 2012

(54) SHUTTER MECHANISM

(75) Inventors: Hideo Yoshizawa, Kanagawa (JP); Yukinori Sakuma, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 731 days.

(21) Appl. No.: 12/340,093

(22) Filed: Dec. 19, 2008

(65) Prior Publication Data

US 2009/0158667 A1 Jun. 25, 2009

(30) Foreign Application Priority Data

Dec. 25, 2007 (JP) ..... 2007-331787
Jan. 31, 2008 (JP) ..... 2008-021360
Jul. 15, 2008 (JP) ..... 2008-183274

(51) Int. Cl.
*G03G 15/00* (2006.01)
*G03G 15/08* (2006.01)

(52) U.S. Cl. ..... 399/110; 399/260; 399/262

(58) Field of Classification Search ..... 399/110, 399/258, 260, 262
See application file for complete search history.

(56) References Cited

U.S. PATENT DOCUMENTS 5,765,079 A 6/1998 Yoshiki et al.
5,794,108 A 8/1998 Yoshizawa et al.
5,970,290 A 10/1999 Yoshiki et al.
6,198,895 B1 3/2001 Tsuda et al.
6,337,957 B1 1/2002 Tamaki et al.
6,522,855 B1 2/2003 Terai et al.
6,553,202 B2 4/2003 Tamaki et al.
6,795,673 B2 9/2004 Yoshizawa
6,826,381 B2 11/2004 Muramatsu et al.
6,975,830 B2 12/2005 Murakami et al.
6,993,267 B2 1/2006 Yoshiyuki et al.
6,993,281 B2 1/2006 Yoshizawa et al.
7,110,699 B2 9/2006 Yoshizawa et al.
7,184,684 B2 2/2007 Murakami et al.
7,212,773 B2 5/2007 Sudo et al
7,228,093 B2 6/2007 Sakai et al.
7,292,817 B2 11/2007 Murakami et al.
7,295,796 B1 11/2007 Murakami et al.
2006/0029435 A1 2/2006 Kasai et al.
2007/0104516 A1 5/2007 Katoh et al.
2007/0122205 A1 5/2007 Taguchi et al.
2007/0147900 A1 6/2007 Taguchi et al.

(Continued)

FOREIGN PATENT DOCUMENTS

JP 11-143202 5/1999

(Continued)

OTHER PUBLICATIONS

U.S. Appl. No. 60/850,675, filed Oct. 11, 2006, Kurenuma Takeroh.

*Primary Examiner* — Hoang Ngo
(74) *Attorney, Agent, or Firm* — Oblon, Spivak, McClelland, Maier & Neustadt, L.L.P.

(57) ABSTRACT

A shutter mechanism is provided in a supply port through which powder is supplied to a second device from a first device. The shutter mechanism includes a shutter that opens and closes the supply port in conjunction with attaching and detaching operation of the second device with respect to the first device and a guide groove that is provided in a recess manner so as not to be exposed from the supply port as viewed from the second device and guides the opening and closing operation of the shutter. A space is formed between the guide groove and an end portion of the supply port making contact with the shutter when the shutter closes the supply port.

20 Claims, 16 Drawing Sheets

U.S. PATENT DOCUMENTS

| | | | |
|---|---|---|---|
| 2007/0147902 | A1 | 6/2007 | Taguchi et al. |
| 2007/0154243 | A1 | 7/2007 | Taguchi et al. |
| 2007/0154244 | A1 | 7/2007 | Taguchi et al. |
| 2007/0160393 | A1 | 7/2007 | Taguchi et al. |
| 2007/0160394 | A1 | 7/2007 | Taguchi et al. |
| 2007/0177886 | A1 | 8/2007 | Taguchi et al. |
| 2008/0124133 | A1 | 5/2008 | Yoshizawa et al. |

FOREIGN PATENT DOCUMENTS

| | | |
|---|---|---|
| JP | 2986588 | 10/1999 |
| JP | 3968268 | 6/2007 |

SHUTTER MECHANISM

CROSS-REFERENCE TO RELATED APPLICATIONS

The present application claims priority to and incorporates by reference the entire contents of Japanese priority document 2007-331787 filed in Japan on Dec. 25, 2007, 2008-021360 filed in Japan on Jan. 31, 2008, and 2008-183274 filed in Japan on Jul. 15, 2008.

BACKGROUND OF THE INVENTION

1. Field of the Invention

The present invention relates to a shutter mechanism provided in a supply port for supplying powder, such as toner and two-component developer, to a second device connected to a first device from the first device.

2. Description of the Related Art

There is conventionally known a technology for providing a shutter mechanism in a supply port for supplying powder such as toner and a two-component developer to a second device connected to a first device in an image forming apparatus using an electrophotographic system such as a copy machine, a printer, a facsimile machine, and a multifunction product of these devices, as disclosed in, for example, Japanese Patent Application Laid-open No. 2003-341759.

Specifically, in Japanese Patent Application Laid-open No. 2003-341759, when a nozzle (second device) of a toner supply device is relatively attached or detached to or from a toner container (first device), a shutter provided in the supply port of the toner container is opened or closed in conjunction with its attaching/detaching operation. The shutter mechanism that automatically opens or closes the shutter in conjunction with the attaching/detaching operation of the device can prevent such a failure that a large amount of toner scatters from the supply port when the toner container is removed from the apparatus, as compared with a shutter mechanism in which a shutter is manually opened or closed. The shutter mechanism can also prevent such a failure that toner is not supplied to the toner supply device because the shutter is not opened due to some error when the toner container is attached thereto.

Meanwhile, Japanese Patent Application Laid-open No. H11-143202 and Japanese Patent No. 2986588 disclose technologies for a shutter mechanism provided in a supply port of a toner supply container (first device). The shutter mechanism is configured to form a guide groove for guiding an opening/closing operation of a shutter in a recess manner so as not to be exposed from the supply port as viewed from a developer hopper (second device). Japanese Patent Application Laid-open No. H11-143202 and the like also disclose technologies for providing a sealing element in a space between both end portions of the shutter and the guide groove to ensure sealing capability between the shutter and the first device.

The conventional shutter mechanisms have such problems that the opening/closing operation of the shutter is not smoothly performed or the sealing capability around the shutter decreases while the opening/closing operation of the shutter is being repeated in conjunction with the attaching/detaching operation between the first device and the second device.

Specifically, in the technologies in Japanese Patent Application Laid-open No. H11-143202 and Japanese Patent No. 2986588, because the shutter in a plate shape is internally provided in the first device, the sealing capability between the supply port and the opening of the second device can be increased as compared with the shutter mechanism disclosed in Japanese Patent Application Laid-open No. 2003-341759 in which the shutter is interposed between the supply port in the first device and the opening of the second device. The increase in the sealing capability allows greater flexibility of the shape and layout of the supply port of the first device or the shape and layout of the opening of the second device.

However, because the shutter and the guide groove are internally provided in the first device, toner adheres to the guide groove and to the front end portion of the shutter while the opening/closing operation of the shutter is being repeated, and the toner is eventually firmly fixed thereto. The firmly fixed toner prevents the shutter from a smooth opening/closing operation, and the improper opening/closing operation of the shutter results in toner supply failure and toner scattering.

Such problems commonly occur even in a shutter mechanism provided with a supply port through which any powder (e.g., two-component developer) other than the toner is supplied.

SUMMARY OF THE INVENTION

It is an object of the present invention to at least partially solve the problems in the conventional technology.

According to one aspect of the present invention, there is provided a shutter mechanism provided in a supply port through which powder is supplied to a second device from a first device. The shutter mechanism includes a shutter that opens and closes the supply port in conjunction with attaching and detaching operation of the second device with respect to the first device; and a guide groove that is provided in a recess manner so as not to be exposed from the supply port as viewed from the second device and guides the opening and closing operation of the shutter. A space is formed between the guide groove and an end portion of the supply port making contact with the shutter when the shutter closes the supply port.

Furthermore, according to another aspect of the present invention, there is provided a shutter mechanism provided in a supply port through which powder is supplied to a second device from a first device. The shutter mechanism includes a shutter that opens and closes the supply port in conjunction with attaching and detaching operation of the second device with respect to the first device; a guide groove that is provided in a recess manner so as not to be exposed from the supply port as viewed from the second device and guides the opening and closing operation of the shutter; and an elastic member provided in the first device to seal a space formed with the shutter in a state of opening the supply port. When the shutter opens the supply port, the elastic member deforms in conjunction with the opening operation to cover a front end portion of the shutter.

Moreover, according to still another aspect of the present invention, there is provided a shutter mechanism provided in a supply port through which powder is supplied to a second device from a first device. The shutter mechanism includes a shutter that opens and closes the supply port in conjunction with attaching and detaching operation of the second device with respect to the first device; and an elastic member provided in the first device to seal a space formed with the shutter in a state of opening the supply port. The elastic member includes a non-adhesive portion that is not adhered to the first device, and when the shutter opens the supply port, the non-adhesive portion deforms in conjunction with the opening operation to cover the front end portion of the shutter.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
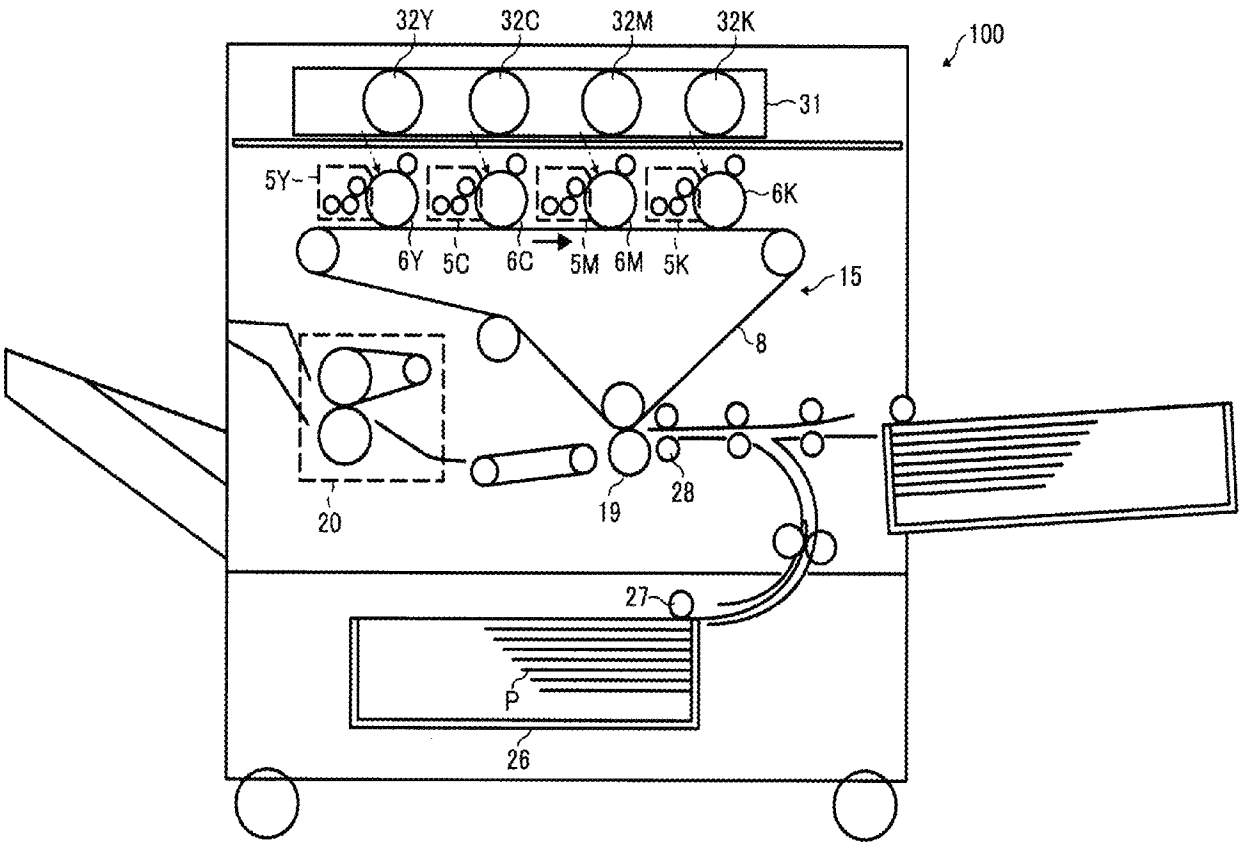
FIG. 1 is an overall schematic of an image forming apparatus according to a first embodiment of the present invention.

Exemplary embodiments of the present invention are explained in detail below with reference to the accompanying drawings. It is noted that same reference numerals are assigned to same or corresponding portions in figures, and explanation thereof is simplified or omitted as required.

A first embodiment of the present invention will be explained in detail below with reference to FIGS. 1 to 11.

First, an overall configuration and operation of an image forming apparatus are explained with reference to FIGS. 1 to 3.

Figure 2:
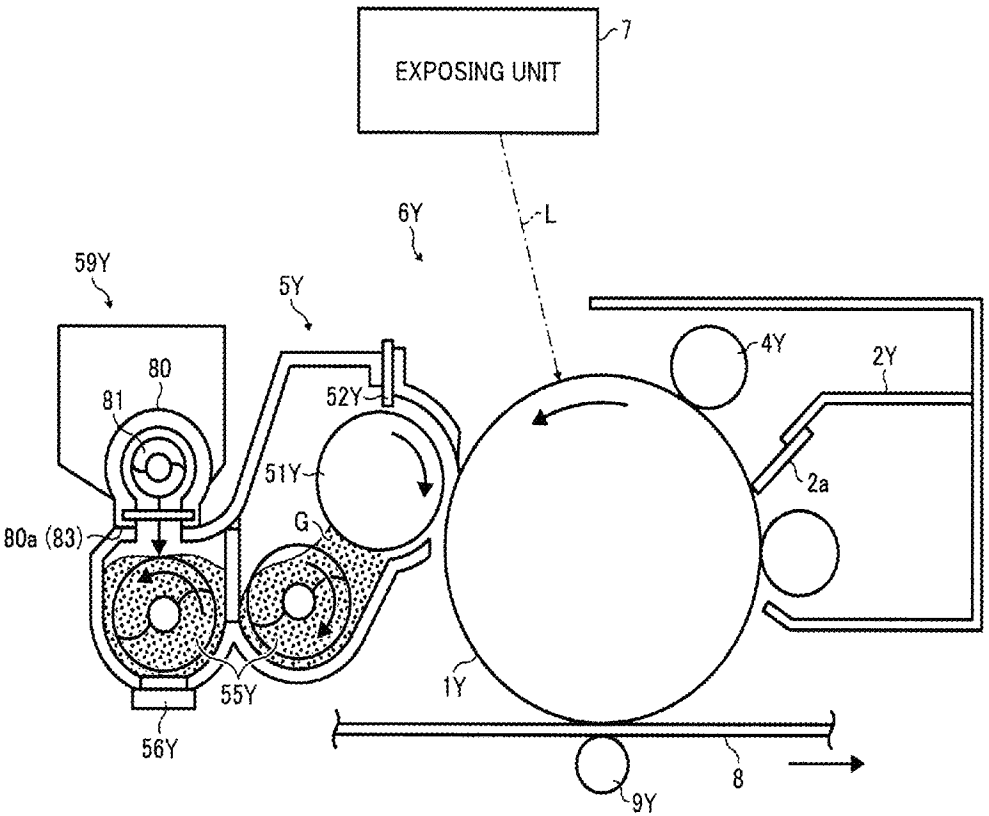
FIG. 2 is a cross section of an imaging unit.
Figure 3:
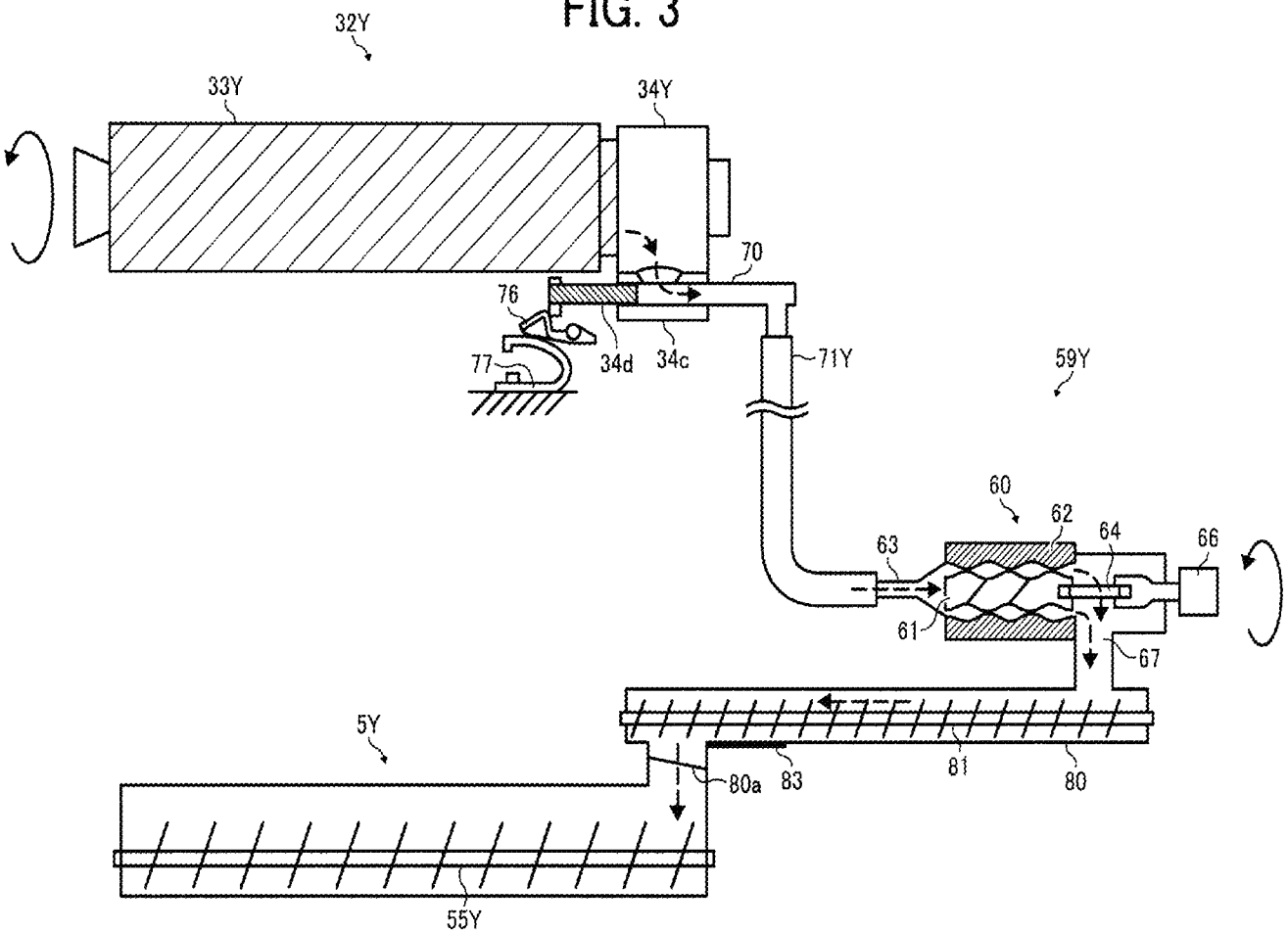
FIG. 3 is a schematic of a toner supply path.

FIG. 1 is an overall schematic of a printer as the image forming apparatus, FIG. 2 is an enlarged schematic of an imaging unit in the printer, and FIG. 3 is a schematic of a toner supply path in the imaging unit.

As shown in FIG. 1, four toner containers 32Y, 32M, 32C, and 32K corresponding to colors (Yellow, Magenta, Cyan, and Black), respectively, are detachably (replaceably) attached to a toner-container storage unit 31 which is provided in the upper part of the body of an image forming apparatus 100 (hereinafter, "apparatus body 100") (also see the perspective view of FIG. 5).

An intermediate transfer unit 15 is placed below the toner-container storage unit 31. Imaging units 6Y, 6M, 6C, and 6K corresponding to the colors, respectively, are arranged to be opposed to an intermediate transfer belt 8 of the intermediate transfer unit 15.

Referring to FIG. 2, the imaging unit 6Y includes a photosensitive drum 1Y, and a charger 4Y, a developing device 5Y (developing unit), a cleaning unit 2Y (cleaning device), and a decharger (not shown) which are arranged around the photosensitive drum 1Y. Imaging processes such as a charging process, an exposing process, a developing process, a transfer process, and a cleaning process are performed on the photosensitive drum 1Y, so that a yellow image is formed on the photosensitive drum 1Y.

The other three imaging units 6M, 6C, and 6K and toner supply devices 59M, 59C, and 59K are configured nearly identically to the imaging unit 6Y and a toner supply device 59Y corresponding to yellow, except for different colors of the toners to be used, and images corresponding to the colors are formed, respectively. Hereafter, explanation of the other three imaging units 6M, 6C, and 6K and toner supply devices 59M, 59C, and 59K is omitted as required, and only the imaging unit 6Y and the toner supply device 59Y are explained below.

Referring to FIG. 2, the photosensitive drum 1Y is driven to rotate counterclockwise in FIG. 2 by a drive motor (not shown). The surface of the photosensitive drum 1Y is uniformly charged at a position of the charger 4Y (charging process).

Thereafter, the surface of the photosensitive drum 1Y reaches an irradiation position of a laser beam L emitted from the exposing device 7 (exposing unit), where an electrostatic latent image corresponding to yellow is formed by being exposed and scanned with the laser beam (exposing process).

Then, the surface of the photosensitive drum 1Y reaches an opposed position to the developing device 5Y, where the electrostatic latent image is developed, to form a yellow toner image (developing process).

Thereafter, the surface of the photosensitive drum 1Y reaches an opposed position to the intermediate transfer belt 8 and a primary-transfer bias roller 9Y, where the toner image on the photosensitive drum 1Y is transferred to the intermediate transfer belt 8 (primary transfer process). At this time, a slight amount of "non-transferred toner" remains on the photosensitive drum 1Y.

Then, the surface of the photosensitive drum 1Y reaches an opposed position to the cleaning unit 2Y (cleaning device), where the non-transferred toner remaining on the photosensitive drum 1Y is mechanically collected by a cleaning blade 2*a* (cleaning process).

Lastly, the surface of the photosensitive drum 1Y reaches an opposed position to the decharger (not shown), where the residual potential on the photosensitive drum 1Y is removed.

Thus, a series of the imaging processes performed on the photosensitive drum 1Y is finished.

The imaging processes in the yellow imaging unit 6Y are similarly performed in the other imaging units 6M, 6C, and 6K. That is, each laser beam L based on image information is irradiated from the exposing unit 7 provided above the imaging units 6M, 6C, and 6K to each photosensitive drum of the imaging units 6M, 6C, and 6K. Specifically, the exposing unit 7 emits the laser beam L from a light source and irradiates the photosensitive drum with the laser beam L through a plurality of optical elements while scanning the laser beam L by a polygon mirror which is driven to rotate.

Thereafter, toner images of the colors formed on the photosensitive drums through the developing process are transferred to the intermediate transfer belt 8 in a superimposed manner. Thus, color images are formed on the intermediate transfer belt 8 of the intermediate transfer unit 15.

Then, the intermediate transfer belt 8 with the toner images of the colors superimposed on each other reaches an opposed position to a secondary transfer roller 19. At this position, a secondary-transfer backup roller holds the intermediate transfer belt 8 with the secondary transfer roller 19, and a secondary transfer nip is thereby formed between the intermediate transfer belt 8 and the secondary transfer roller 19. The four-color toner images formed on the intermediate transfer belt 8 are transferred to a recording medium P such as a transfer paper conveyed to a position of the secondary transfer nip. At this time, non-transferred toner which has not been transferred to the recording medium P remains on the intermediate transfer belt 8.

Thereafter, the intermediate transfer belt 8 reaches a position of an intermediate-transfer-belt cleaning unit, where the non-transferred toner is collected from the intermediate transfer belt 8.

Thus, a series of the transfer processes performed on the intermediate transfer belt 8 is finished.

Here, the recording medium P to be conveyed to the position of the secondary transfer nip is conveyed from a paper feeding unit 26 placed below the apparatus body 100 through a paper feeding roller 27 and a registration roller pair 28 or the like.

Specifically, a stack of recording media P such as transfer paper is stored in the paper feeding roller 27. The paper feeding roller 27 is driven to rotate counterclockwise in FIG. 1, and a top recording medium P is fed to the registration roller pair 28.

The recording medium P conveyed to the registration roller pair 28 stops once at a position of a roller nip of the registration roller pair 28 caused to stop the rotation. The registration roller pair 28 is then driven to rotate at a timing of synchronizing the color images on the intermediate transfer belt 8, and the recording medium P is conveyed toward the secondary transfer nip. In this manner, a desired color image is transferred to the recording medium P.

Thereafter, the recording medium P with the color image transferred thereto at the position of the secondary transfer nip is conveyed to a position of a fixing unit 20. At this position, the color image on the surface of the recording medium P is fixed on the recording medium P under heat and pressure by a fixing belt and a pressing roller. Thereafter, the recording medium P is discharged as an output image to the outside of the machine.

Thus, a series of image forming processes is completed in the image forming apparatus.

The configuration and the operation of the developing device in the imaging unit will be explained in further detail below with reference to FIG. 2.

The developing device 5Y includes a developing roller 51Y opposed to the photosensitive drum 1Y, a doctor blade 52Y opposed to the developing roller 51Y, two conveyor screws 55Y, and a concentration detection sensor 56Y that detects toner concentration in a developer. The developing roller 51Y is formed with a magnet fixed to the inside thereof and a sleeve that is made to rotate around the magnet. Stored in the developing device 5Y is a two-component developer G containing carrier and toner. The developing device 5Y (second device) communicates with the toner supply device 59Y (first device) through an opening (a supply port 80*a*) formed above the developing device 5Y.

The developing device 5Y configured in the above manner operates as follows.

The sleeve of the developing roller 51Y rotates in the arrow direction of FIG. 2. The developer G carried on the developing roller 51Y due to a magnetic field produced by the magnet moves along the developing roller 51Y with rotation of the sleeve.

Here, the developer G in the developing device 5Y is controlled so that a ratio (toner concentration) of the toner to the developer falls within a predetermined range. Specifically, the toner contained in the toner container 32Y is supplied into the developing device 5Y through the toner supply device 59Y (see FIG. 3) according to toner consumption in the developing device 5Y.

Thereafter, the toner supplied into the developing device 5Y circulates (moves in a direction perpendicular to the paper plane of FIG. 2) between partitioned two developer containers while being mixed and agitated with the developer G. The toner in the developer G is attracted to the carrier due to frictional charge therewith, and is carried on the developing roller 51Y together with the carrier due to magnetic force created on the developing roller 51Y.

The developer G on the developing roller 51Y is conveyed in the arrow direction of FIG. 2 to reach the position of the doctor blade 52Y. The amount of the developer G on the developing roller 51Y is controlled to an appropriate amount at this position, and is then conveyed up to an opposed position (developing region) to the photosensitive drum 1Y. The toner is attracted to the latent image formed on the photosensitive drum 1Y due to an electric field produced in the developing region. Thereafter, the developer G remaining on the developing roller 51Y reaches the upper side of the developer container with rotation of the sleeve, where the developer G separates from the developing roller 51Y.

Next, the toner supply device 59Y (supply device) being a powder supply device that guides the toner contained in the toner container 32Y to the developing device 5Y is explained in detail below with reference to FIGS. 3 and 4.

Figure 4:
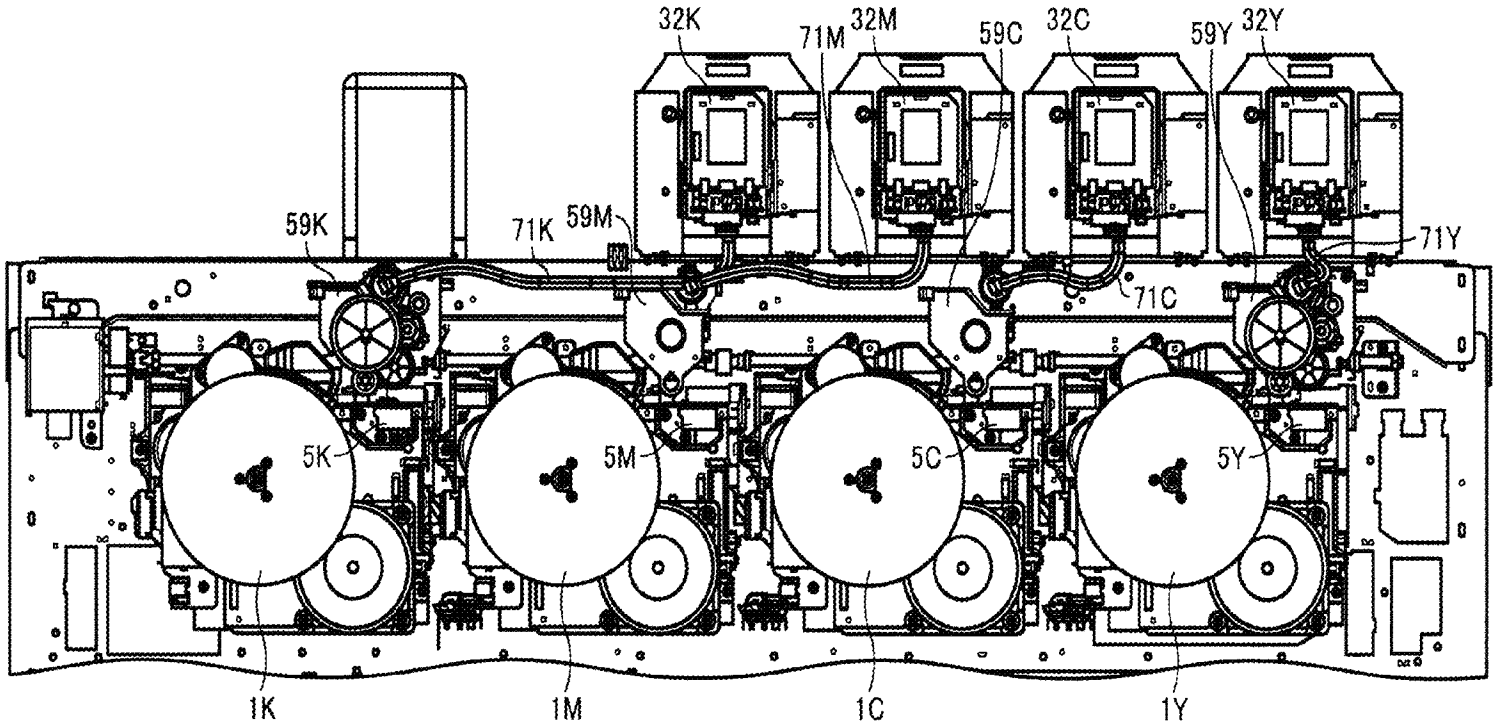
FIG. 4 is a rear view of the toner supply path as viewed from the rear side.

Referring to FIG. 4, respective toners in the toner containers 32Y, 32M, 32C, and 32K (containers) set in the toner-container storage unit 31 of the apparatus body 100 are supplied to the developing devices through toner supply paths provided for the colors, respectively, as required according to toner consumptions in the developing devices 5Y, 5M, 5C, and 5K. Specifically, the toners (powder) in the toner containers 32Y, 32M, 32C, and 32K are conveyed to the toner supply devices 59Y, 59M, 59C, and 59K through tubes 71Y, 71M, 71C, and 71K, and are then supplied to the developing devices 5Y, 5M, 5C, and 5K through the supply ports, respectively. The four toner supply paths are nearly identically configured except for different colors of the toners for use in the imaging processes.

More specifically, referring to FIG. 3, when the toner container 32Y is set in the toner-container storage unit 31 of the apparatus body 100, a nozzle 70 of the toner-container storage unit 31 is connected to a portion to be held (hereinafter, "held portion") 34Y of the toner container 32Y. At this time, a plug element 34*d* of the toner container 32Y is sandwiched by the nozzle 70 and a claw element 76 (biased by a plate spring 77), and opens a toner discharge port 34*c* of the held portion 34Y in this state. Thus, the toner contained in a container body 33Y of the toner container 32Y is conveyed into the nozzle 70 through the toner discharge port 34*c*.

Meanwhile, the other end of the nozzle 70 is connected to one end of the tube 71Y. The tube 71Y is formed with a flexible material highly resistant to toner, and the other end of the tube 71Y is connected to a screw pump 60 (Mohno pump) of the toner supply device 59Y.

The tube 71Y is formed so that its internal diameter becomes 4 millimeters to 10 millimeters. A material of the tube 71Y can be a rubber material such as polyurethane, nitrile, EPDM, and silicone; and a resin material such as polyethylene and nylon. The use of such a flexible tube 71Y allows an increase in flexibility of the layout of the toner supply path and minimization of the image forming apparatus.

The screw pump 60 is a suction-type uniaxial eccentric screw pump, which includes a rotor 61, a stator 62, a suction port 63, a universal joint 64, and a motor 66. The rotor 61, the stator 62, and the universal joint 64 or the like are stored in a case (not shown). The stator 62 is a female screw element made of an elastic member such as rubber, and forms a double-pitch spiral groove inside thereof. The rotor 61 is a male screw element formed in such a manner that a shaft made of rigid material such as metal is spirally twisted, and is rotatably inserted in the stator 62. One end of the rotor 61 is rotatably connected to the motor 66 through the universal joint 64.

The screw pump 60 configured in the above manner is driven to rotate the rotor 61 in the stator 62 by the motor 66 in a predetermined direction, to thereby produce suction force in the suction port 63, specifically, to thereby produce a negative air pressure in the tube 71Y by sending air in the tube 71Y. Thus, the toner (powder) in the toner container 32Y with the air is sucked to the suction port 63 through the tube 71Y. The toner sucked up to the suction port 63 is sent into a space between the stator 62 and the rotor 61 and is output to the other end of the rotor 61 with rotation of the rotor 61. The output toner is discharged from a outlet port 67 of the screw pump 60 and reaches a toner conveying unit 80. The toner having reached the toner conveying unit 80 of the toner supply device 59Y (first device) is conveyed by a conveyor screw 81 from the right side to the left side of FIG. 3, and is supplied to the developing device 5Y (second device) through the supply port 80*a* (moved in the dotted arrow direction of FIG. 3). The shutter mechanism (shutter 83) is provided in the supply port 80*a* of the toner conveying unit 80 in the toner supply device 59Y, however, this mechanism will be explained in detail later.

As explained with reference to FIGS. 1 and 4, the four toner containers 32Y, 32M, 32C, and 32K (containers) in an approximate cylindrical shape are detachably attached to the toner-container storage unit 31 (see FIG. 5). The toner containers 32Y, 32M, 32C, and 32K are replaced with new ones when they reach their usefulness, that is, when almost all toners contained therein are consumed and the containers become emptied. The toners of the colors contained in the toner containers 32Y, 32M, 32C, and 32K are supplied to the developing devices 5Y, 5M, 5C, and 5K as required through the toner supply devices 59Y, 59M, 59C, and 59K as explained with reference to FIG. 3, respectively.

The first embodiment uses toner, being powder, contained in the toner containers 32Y, 32M, 32C, and 32K formed so that a following relationship holds true:

$$3 \leqq Dv \leqq 8 \quad (1)$$

$$1.00 \leqq Dv/Dn \leqq 1.40 \quad (2)$$

where Dv (micrometer) is a volume-average particle size and Dn (micrometer) is a number-average particle size. Thus, toner particles are selected according to an image pattern upon the developing process, and satisfactory image quality is maintained and also satisfactory development capability is maintained even when the toner particles are agitated for long time in the developing device. Moreover, the toner is efficiently and reliably conveyed without blocking the toner supply path such as the tube 71Y.

The volume-average particle size and the number-average particle size of toner can be measured using, as a typical one, a Coulter Counter type particle-size distribution measuring instrument "Coulter Counter TA-II" or "Coulter Multisizer II" (both manufactured by Coulter Electronics Limited).

Furthermore, the first embodiment uses substantially spherical toner, as the toner contained in the toner containers 32Y, 32M, 32C, and 32K, formed so that a shape factor SF-1 is in a range of 100 to 180 and a shape factor SF-2 is in a range of 100 to 180. This enables to minimize reduction in cleaning performance while maintaining high transfer efficiency. Moreover, the toner is efficiently and reliably conveyed without blocking the toner supply path such as the tube 71Y.

Here, the shape factor SF-1 indicates a sphericity degree of a toner particle, which is determined by a following equation.

$$SF\text{-}1=(M^2/S)\times(100\pi/4)$$

In the equation, M is a maximum particle size of toner particles in a projected plane (maximum particle size among scattered particle sizes), and S is an area of a toner particle in the project plane. Therefore, the toner particle of which shape factor SF-1 is 100 has perfect sphericity, and the sphericity degree decreases as the shape factor SF-1 grows larger than 100.

The shape factor SF-2 indicates irregularity of toner particles, which is determined by a following equation.

$$SF\text{-}2=(N^2/S)\times(100/4\pi)$$

In the equation, N is a circumferential length of a toner particle in the project plane, and S is an area of a toner particle in the project plane. Therefore, the toner particle of which shape factor SF-2 is 100 has no irregularity, and the irregularity increases as the shape factor SF-2 grows larger than 100.

The shape factor SF-1 and the shape factor SF-2 are determined by using a scanning electron microscope "S-800" (manufactured by Hitachi Ltd.) to take toner particle pictures and analyzing them using an image analyzer "LUSEX3" (manufactured by Nireco Corp.).

The attaching/detaching operation of the toner container 32Y to/from the toner-container storage unit 31 is briefly explained below.

Figure 5:
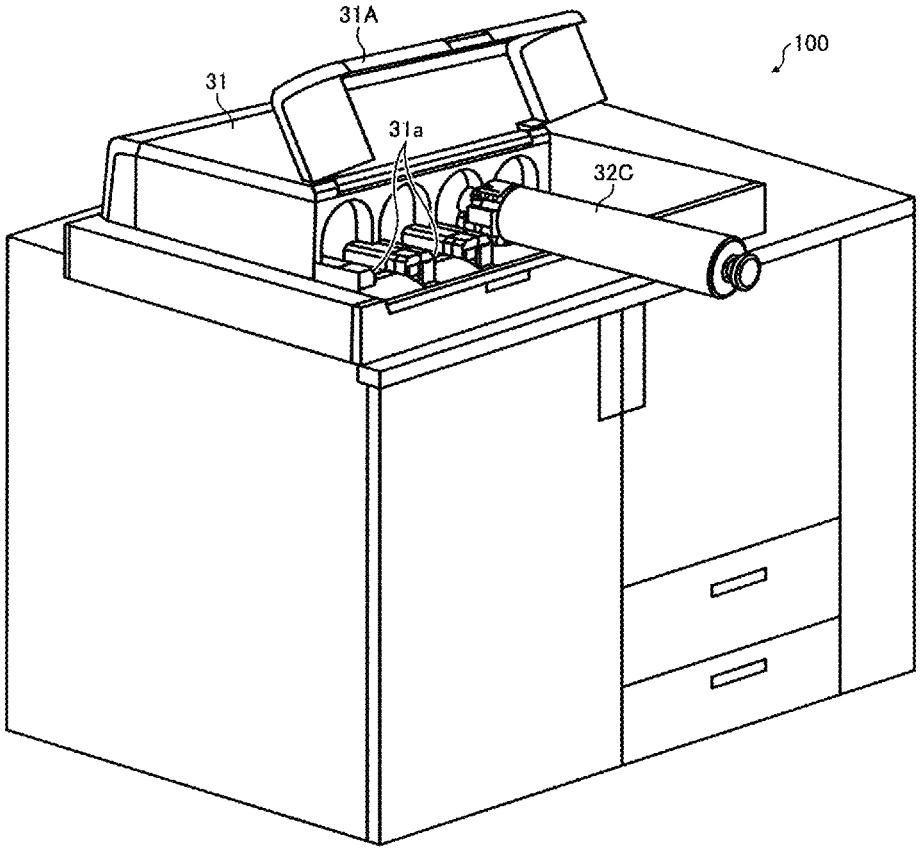
FIG. 5 is a perspective view of the image forming apparatus.

FIG. 5 is a perspective view of how the toner container is set in the image forming apparatus 100 in the first embodiment.

The toner-container storage unit 31 is placed in a topmost portion of the apparatus body 100. The attaching/detaching operation of the toner container is performed by opening/closing a storage-unit cover 31A of the toner-container storage unit 31.

Figure 6A:
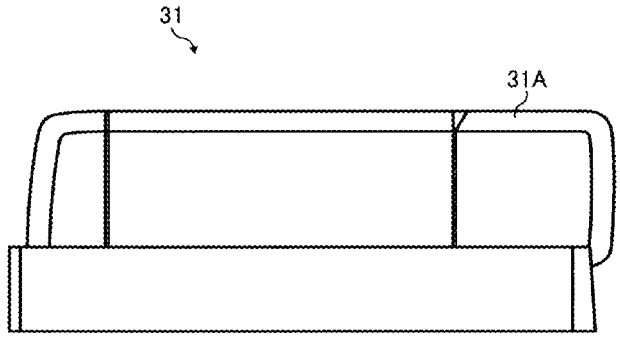
FIGS. 6A to 6D are schematics of how a toner container is set in the image forming apparatus of FIG. 5.
Figure 6B:
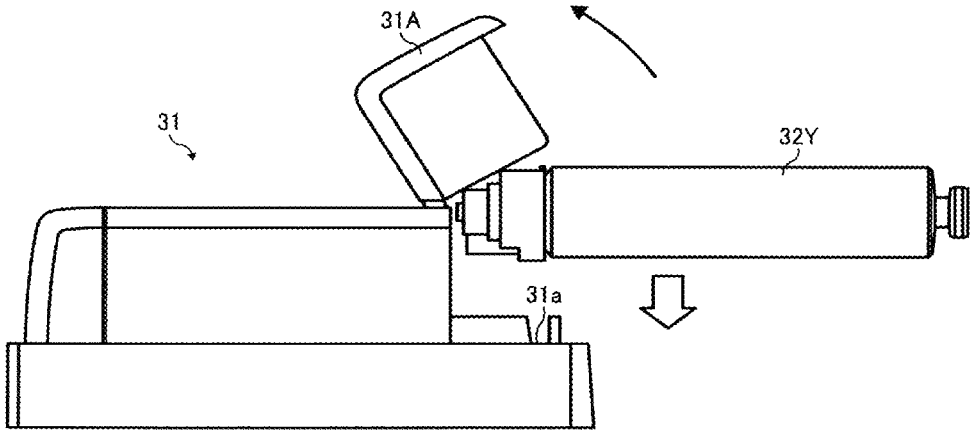

Referring to FIGS. 6A and 6B, when the toner container 32Y is attached to the toner-container storage unit 31, first, the storage-unit cover 31A provided in front of the toner-container storage unit 31 is opened and a sliding face 31*a* of the toner-container storage unit 31 is exposed to outside.

Then, the toner container 32Y is set on the exposed sliding face 31*a* (moved in the white arrow direction of FIG. 6B). Thus, in the first embodiment, by opening the storage-unit cover 31A, a part of the sliding face 31*a* is completely exposed, which makes it easier to set the toner container 32Y on the sliding face 31*a*. In other words, the toner container 32Y can be attached to the toner-container storage unit 31 without causing the user to look into the position of the sliding face 31*a* to check.

Figure 6C:
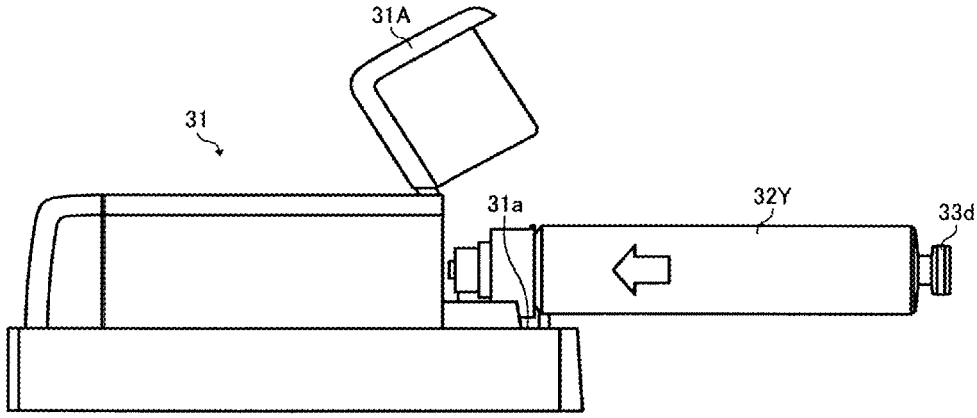

Thereafter, as shown in FIG. 6C, the toner container 32Y is pushed into the toner-container storage unit 31 while sliding it on the sliding face 31*a* (moved in the white arrow direction of FIG. 6C). When the toner container 32Y is set in the toner-container storage unit 31, the nozzle 70 of the toner-container storage unit 31 is connected to the held portion 34Y of the toner container 32Y as explained with reference to FIG. 3.

Figure 6D:
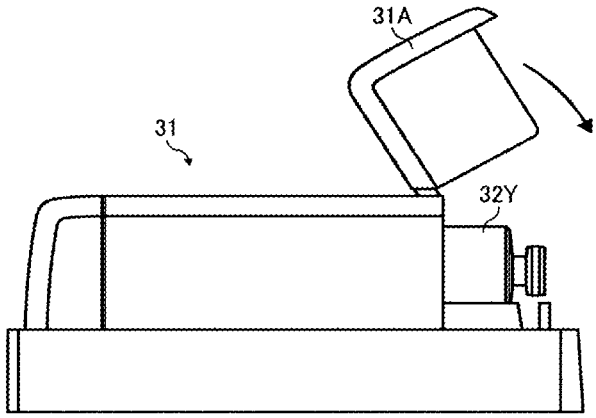

Then, referring to FIG. 6D, after the attaching operation of the toner container 32Y to the toner-container storage unit 31 is completed, the storage-unit cover 31A is closed. Thus, the attaching operation of the toner container 32Y is completed.

On the other hand, when the toner container 32Y is removed (detached) from the toner-container storage unit 31, the procedure is performed in the reverse order of the attachment.

A characteristic shutter mechanism in the toner supply device 59Y according to the first embodiment will be explained below with reference to FIGS. 7 to 11.

Figure 7:
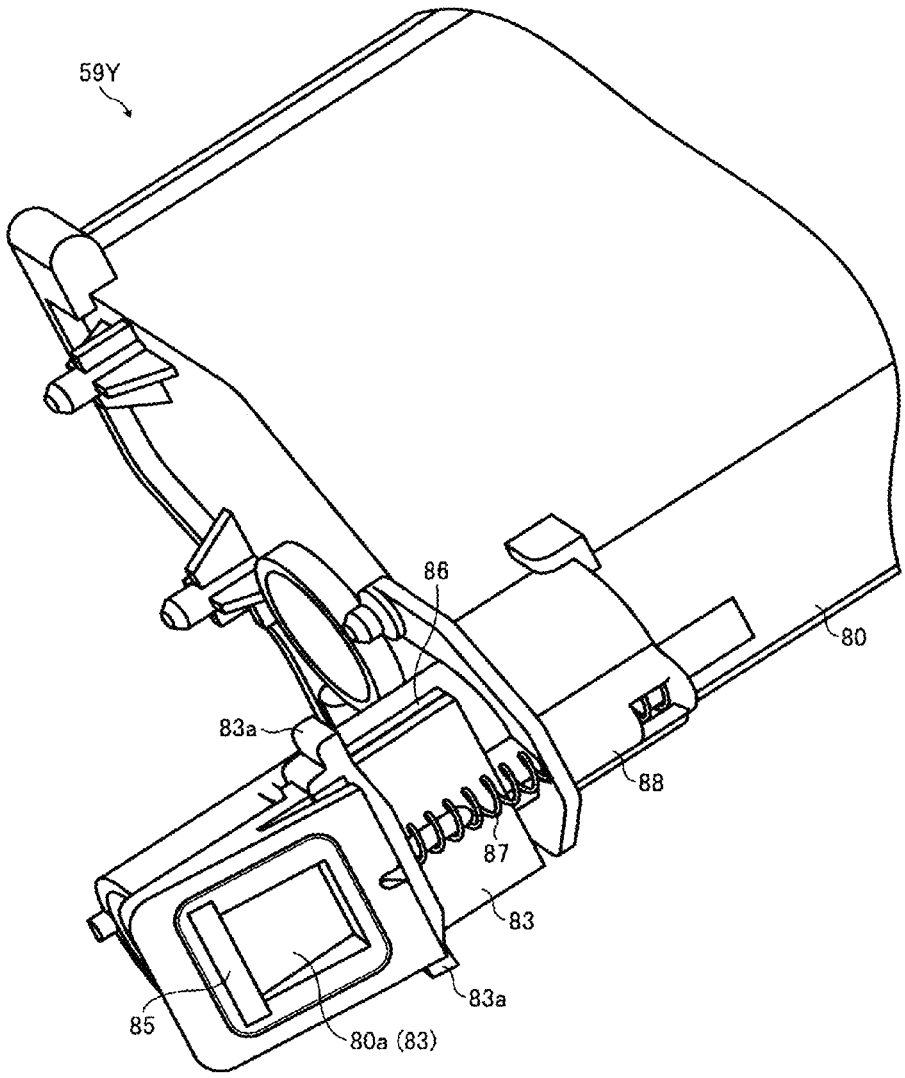
FIG. 7 is a perspective view of a shutter mechanism as viewed from diagonally below.
Figure 8:
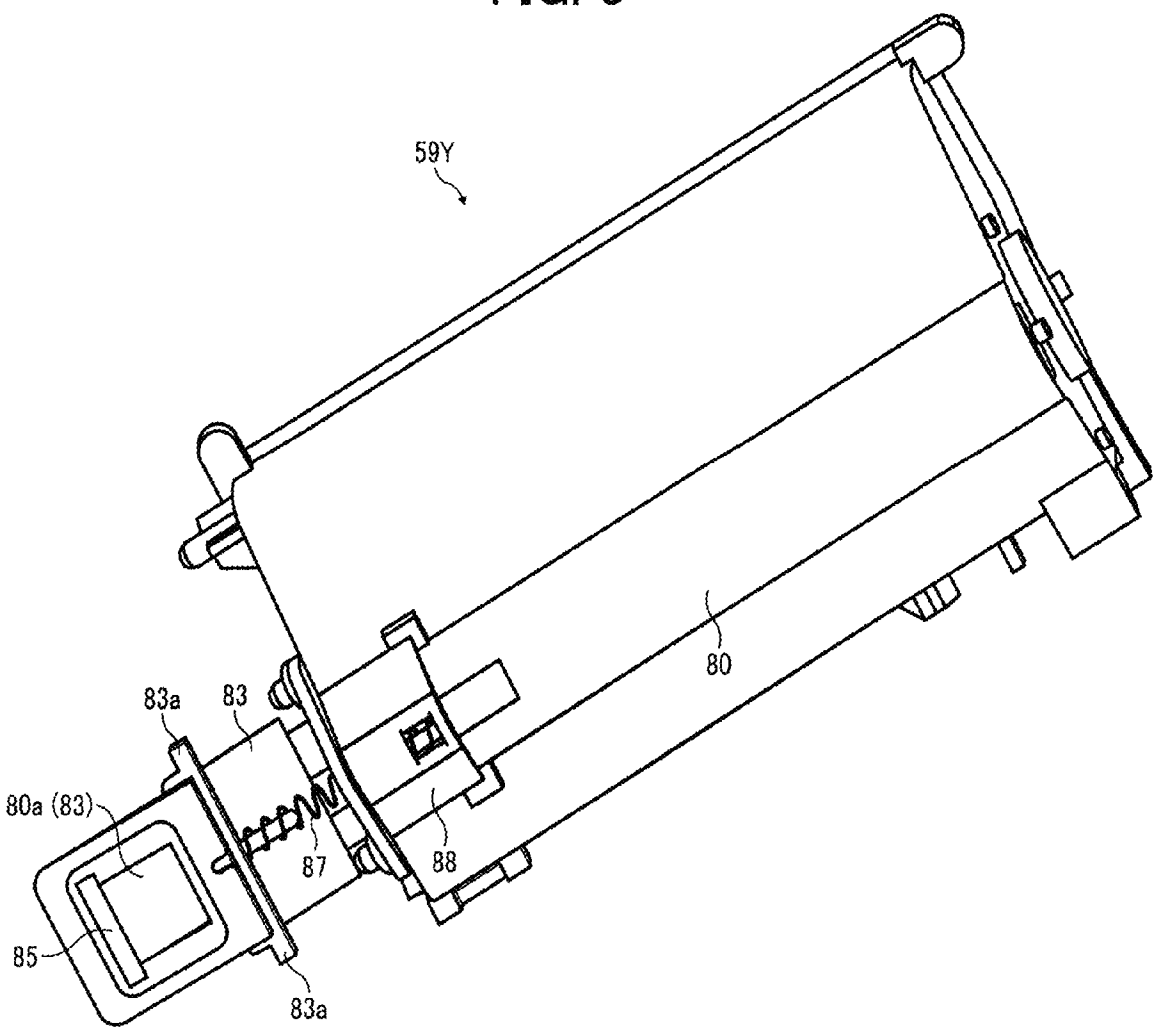
FIG. 8 is a bottom view of the shutter mechanism as viewed from below.
Figure 9:
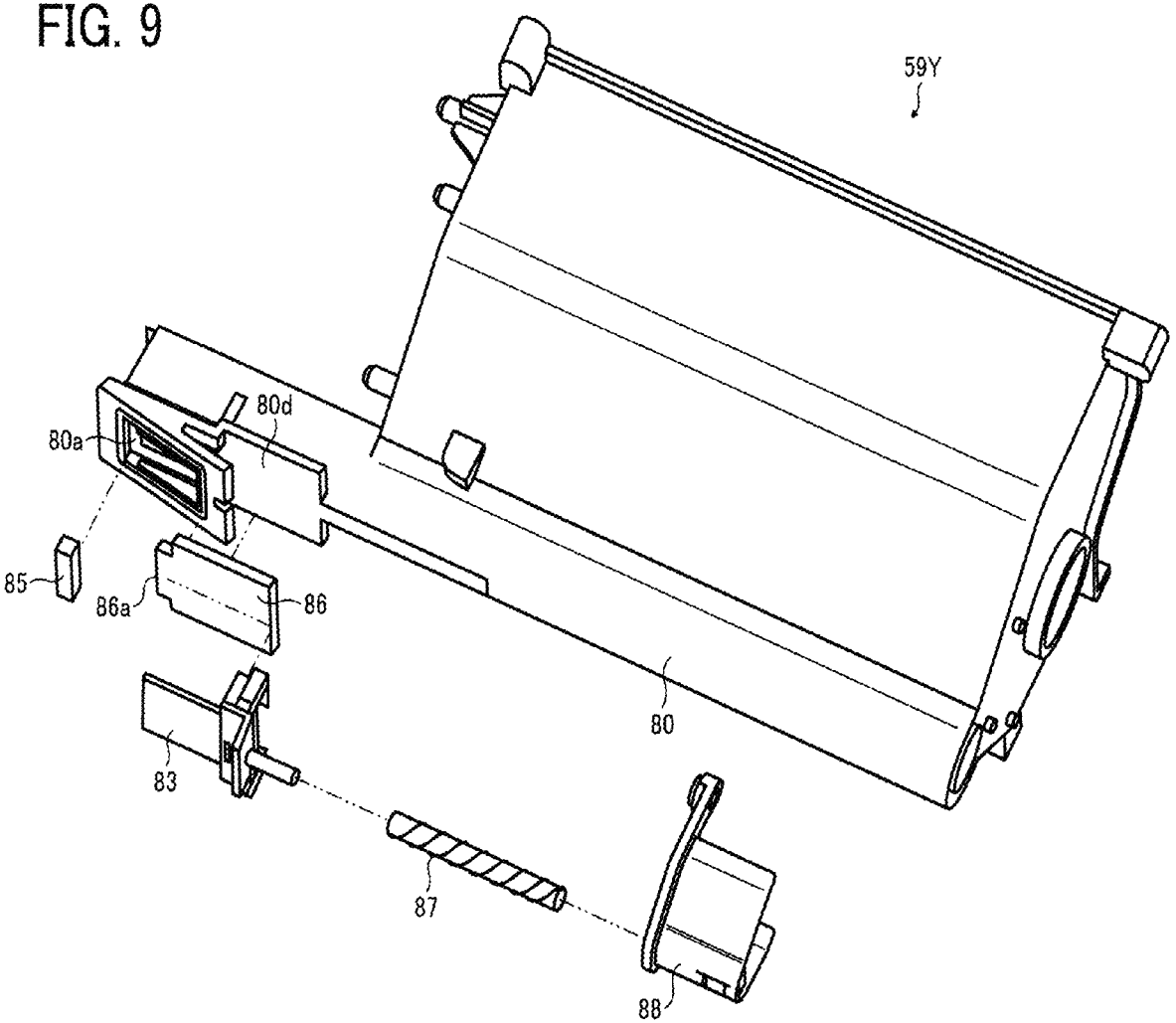
FIG. 9 is an exploded view of the shutter mechanism.
Figure 10A:
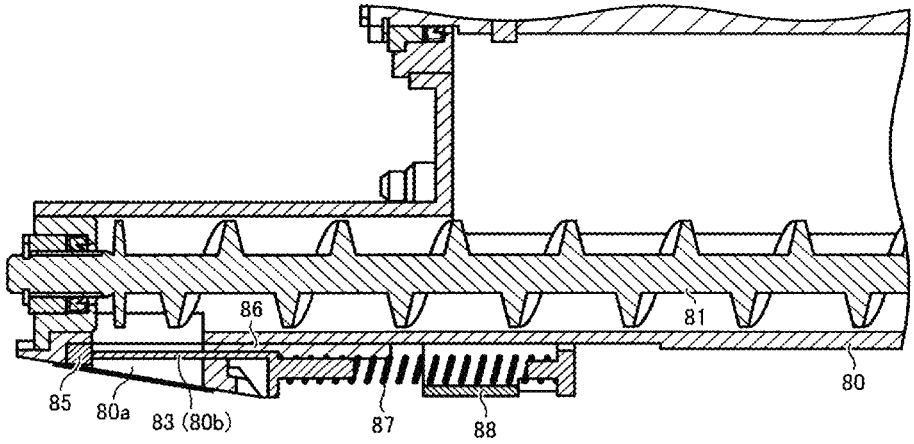
FIGS. 10A and 10B are cross sections of an opening/closing operation of the shutter mechanism.
Figure 10B:
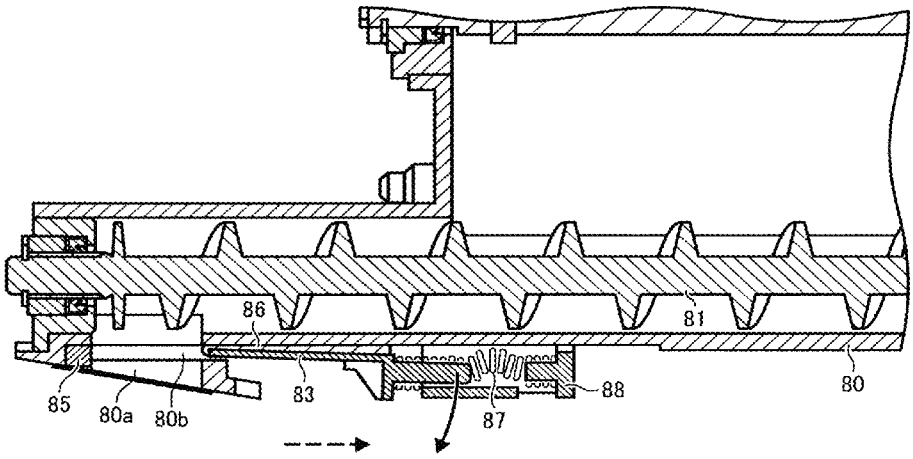
Figure 11:
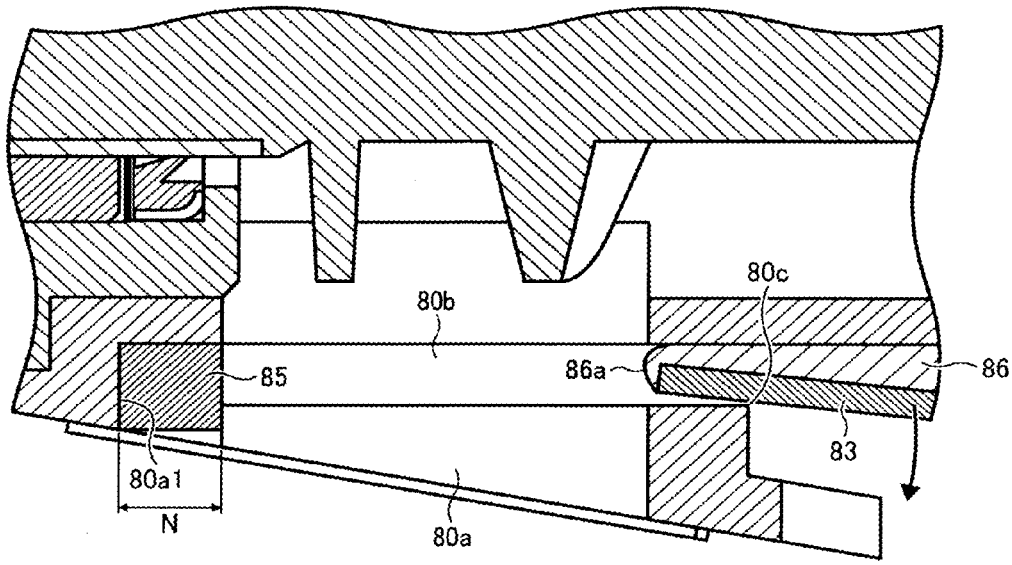
FIG. 11 is an enlarged cross section of the shutter mechanism.

FIG. 7 is a perspective view of the shutter mechanism as viewed from diagonally below, and FIG. 8 is a bottom view of the toner supply device 59Y (shutter mechanism) as viewed from below. FIG. 9 is an exploded view of the shutter mechanism. FIGS. 10A and 10B are cross sections of the opening/closing operation of the shutter mechanism. FIG. 11 is an enlarged cross section of the shutter mechanism when the shutter 83 is opened.

Referring to FIGS. 7 and 8, the supply port 80*a* is provided in the toner conveying unit 80 of the toner supply device 59Y (first device) to supply toner (powder) to the developing device 5Y (second device) connected below the toner conveying unit 80. The shutter mechanism is provided in the supply port 80*a*.

Referring to FIGS. 7 to 11, the shutter mechanism includes the shutter 83, a guide groove 80*b*, a sealing member 85 (first seal), an elastic member 86 (second seal), a compression spring 87 being a biasing member, and a holder 88.

The shutter 83 is configured to open or close the supply port 80*a* in conjunction with the relative attaching/detaching operation of the developing device 5Y (second device) to/from the toner supply device 59Y (first device). Specifically, the guide groove 80*b* is formed near the supply port 80*a* of the toner conveying unit 80. The guide groove 80*b* is engaged with both sides of the shutter 83 in a direction perpendicular to the opening/closing direction of the shutter 83 and guides the opening/closing operation of the shutter 83. The guide groove 80*b* is provided in a recess manner so as not to be exposed from the supply port 80*a* as viewed from the developing device 5Y. Further, a projection to hold one end of the compression spring 87 being a biasing member is provided in a rear end of the shutter 83. The other end of the compression spring 87 is held in a hole of the holder 88. With this configuration, the compression spring 87 allows the shutter 83 to be biased in the direction of closing the supply port 80*a*.

On the other hand, an engaging portion 83*a* is provided in the shutter 83. The engaging portion 83*a* engages with the developing device 5Y in conjunction with the relative attaching operation of the developing device 5Y to the toner supply device 59Y. When the developing device 5Y is set in the apparatus body 100, the engaging portion 83*a* is pushed by a portion to be engaged (not shown) of the developing device 5Y, and the shutter 83 moves along the guide groove 80*b* to resist biasing force of the compression spring 87, to open the supply port 80*a* (FIG. 10B). Here, the engaging portion 83*a* of the shutter 83 is provided in both ends of the shutter 83 in a width direction perpendicular to the attaching direction of the developing device 5Y (horizontal direction in FIG. 10A), and thus, the opening operation of the shutter 83 is performed in a balanced manner.

Referring to FIG. 11, a space N is formed between the guide groove 80*b* and an end portion 80*a*1 of the supply port 80*a* with which the shutter 83 comes in contact (contact through the sealing member 85) when closing the supply port 80*a*. Specifically, the guide groove 80*b* is not formed over the whole area up to the end portion 80*a*1 of the supply port 80*a* in the sliding direction, but the guide groove 80*b* is cut at a position apart from the end portion 80*a*1 by a distance N, to thereby communicate with the supply port 80*a*. The supply port 80*a* communicating with the guide groove 80*b* is formed in a T shape as viewed from below (see FIG. 8).

As explained above, in the first embodiment, because the space N is provided between the guide groove 80*b* and the end portion 80*a*1 of the supply port 80*a*, even if toner adheres to the guide groove 80*b* while the opening/closing operation of the shutter 83 is being repeated, the toner is discharged from the end portion 80*a*1 into the developing device 5Y through the supply port 80*a* without remaining in or being fixed to the guide groove 80*b*. Therefore, the toner is prevented from being firmly fixed to the guide groove 80*b* and the opening/closing operation of the shutter 83 is thereby smoothly performed, which enables to prevent toner supply failure and toner scattering due to improper opening/closing operation of the shutter 83.

Moreover, the sealing member 85 made of foamed polyurethane or the like is adhered to the end portion 80*a*1 of the supply port 80*a*. This enables to prevent toner scattering from between the shutter 83 and the end portion 80*a*1 when the shutter 83 closes the supply port 80*a*. Particularly, in the first embodiment, the above effect can be achieved because by making wider a width of the end portion 80*a*1 (sealing member 85) of the supply port 80*a* formed in the T shape in its width direction (direction perpendicular to the opening/closing direction) than a width of the shutter 83 in the width direction, the whole region of the front end portion of the shutter 83 can be sufficiently sealed with the sealing member 85.

In the shutter mechanism of the first embodiment, to seal between the shutter 83 in the state of the supply port 80*a* being opened and the toner conveying unit 80, the elastic member 86 (second seal) made of foamed polyurethane or the like is adhered to an adherend portion 80d (see FIG. 9) of the toner conveying unit 80. This enables to prevent toner leakage from between the shutter 83 and the toner conveying unit 80 when the shutter 83 is located at the open position.

The elastic member 86 is formed so that when the shutter 83 opens the supply port 80*a*, the elastic member 86 deforms in conjunction with the opening operation to cover the front end portion of the shutter 83. Specifically, a non-adhesive portion 86*a* that is not adhered to the adherend portion 80*d* of the toner conveying unit 80 is formed in the elastic member 86 (see FIGS. 9 and 11). Namely, a portion except for the non-adhesive portion 86*a* (which is protruded at the edge thereof and of which length in the opening/closing direction is set to 2 millimeters to 5 millimeters) of FIG. 9 is an adherend and is adhered to the adherend portion 80*d*. Referring to FIG. 11 or 10B, when the shutter 83 opens the supply port 80*a*, the non-adhesive portion 86*a* deforms in conjunction with the opening operation to cover the front end portion of the shutter 83.

More specifically, the shutter 83 rotates around an edge portion 80*c*, as a pivot point, of the toner conveying unit 80 so that the front end portion of the shutter 83 embeds itself in a part of the elastic member 86 when the supply port 80*a* is opened (rotated in the arrow direction in FIG. 11 or FIG. 10B). In other words, the biasing force due to the compression spring 87 and the force that acts when the supply port 80*a* is opened against the biasing force (force applied to the engaging portion 83*a*) have a positional relationship so that the both forces do not act on the same plane but produce rotational moment. The shutter 83 rotates around the edge portion 80*c* as the pivot point by the rotational moment due to the both forces. This rotation causes the front end portion of the shutter 83 to embed itself in the elastic member 86, and the non-adhesive portion 86*a*, in which shear force is produced due to the opening operation of the shutter 83, deforms to completely cover the front end portion of the shutter 83 (FIG. 11).

As explained above, in the first embodiment, when the shutter 83 opens the supply port 80*a*, the elastic member 86 deforms in conjunction with the opening operation of the shutter 83 to cover the front end portion of the shutter 83. Thus, even if the opening/closing operation of the shutter 83 is repeated, the toner is difficult to adhere to the front end portion of the shutter 83. Consequently, the toner is prevented from being firmly fixed to the front end portion of the shutter 83 and the opening/closing operation thereof is thereby smoothly performed, so that it is possible to prevent toner supply failure and toner scattering due to improper opening/closing operation of the shutter 83.

The closing operation of the shutter 83 is performed in the reverse order of the opening operation.

The elastic member 86 in the first embodiment has a low-friction element (not shown) which is adhered to a plane of the elastic member 86 opposed to the shutter 83, the plane being a position except for the position (non-adhesive portion 86*a*) where the elastic member 86 covers the front end portion of the shutter 83. As the low-friction element, a plate material can be used. The plate material is formed with polyethylene terephthalate or the like which is a material having a lower surface friction coefficient than a surface friction coefficient of the elastic member 86 and having a thickness of about 0.1 millimeter. With this feature, a sliding resistance between the shutter 83 and the elastic member 86 is reduced and the opening/closing operation of the shutter 83 is thereby smoothly performed, and also the shear force producing between the shutter 83 and the non-adhesive portion 86*a* is ensured, so that sealing capability due to the deformation of the non-adhesive portion 86*a* can be ensured.

Furthermore, in the first embodiment, the adherend portion 80*d* (a portion to which the elastic member 86 is adhered) of the toner conveying unit 80 functions also as a guide portion for guiding the opening operation of the shutter 83. Specifically, the opening/closing operation of the shutter 83 is smoothly performed while the engaging portion 83*a* of the shutter 83 is guided by the adherend portion 80*d* as the guide portion.

As explained above, the first embodiment optimizes the guide groove 80*b* for guiding the opening/closing operation of the shutter 83 and the structure of the elastic member 86 provided between the shutter 83 in the state of the supply port 80*a* being opened and the toner supply device 59Y, 59M, 59C, or 59K (first device). Therefore, with a comparatively simple configuration, high sealing capability is provided to the supply port 80*a* through which toner (powder) is supplied from the toner supply device 59Y, 59M, 59C, or 59K to the developing device 5Y, 5M, 5C, or 5K (second device) respectively, so that the opening/closing operation of the shutter 83 is not failed or the sealing capability is not decreased even when the opening/closing operation thereof is repeated.

In the first embodiment, the present invention is applied to the shutter mechanism (or powder supply device) using toner which is powder supplied from the toner supply devices 59Y, 59M, 59C, and 59K (first devices) to the developing devices 5Y, 5M, 5C, and 5K (second devices), respectively. However, the present invention is also applicable to the shutter mechanism (or powder supply device) using the two-component developer containing toner and carrier being powder supplied from the first device to the second device. Moreover, the present invention is applicable to any shutter mechanism (or powder supply device) provided in the supply port for supplying the powder to the second device connected to the first device. Even in these cases, the same effect as that of the first embodiment can be obtained.

In the first embodiment, part of or entire imaging units 6Y, 6M, 6C, and 6K can be provided as a process cartridge or as process cartridges. Even in this case, the same effect as that of the first embodiment can be obtained.

A second embodiment of the present invention will be explained in detail below with reference to FIG. 12.

Figure 12:
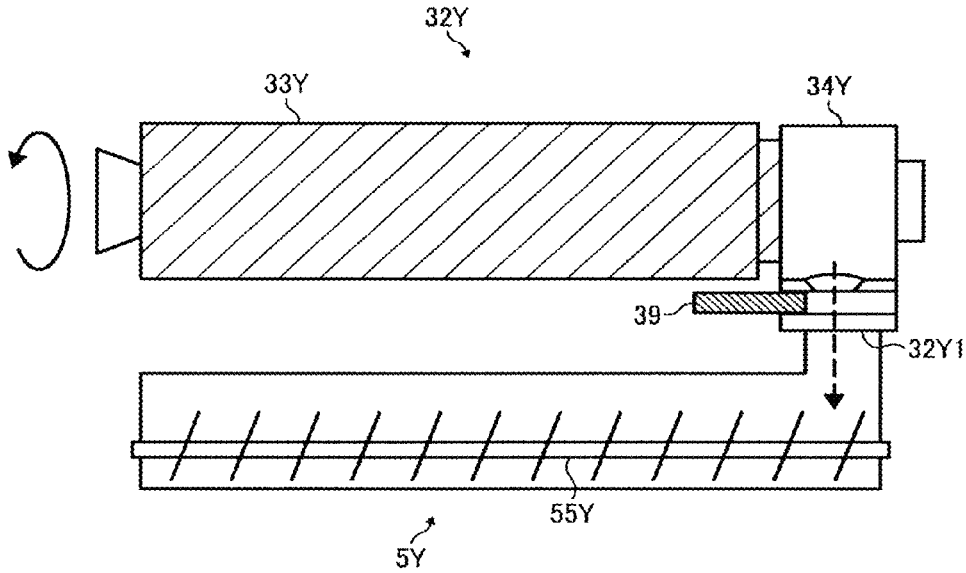
FIG. 12 is a schematic of a shutter mechanism according to a second embodiment of the present invention.

FIG. 12 is a schematic of a shutter mechanism according to the second embodiment. The shutter mechanism of the second embodiment is different from the first embodiment in that the shutter mechanism is provided in a supply port 32Y1 of the toner container 32Y instead of the shutter mechanism being provided in the supply port 80*a* of the toner supply device 59Y according to the first embodiment.

The developing device 5Y in the second embodiment is supplied, differently from the first embodiment, with toner through the supply port 32Y1 of the toner container 32Y being a container that contains new toner. Specifically, the toner is supplied through the supply port 32Y1 to the developing device 5Y or the body of the image forming apparatus (second device) connected to the toner container 32Y (first device), and a shutter mechanism (a shutter 39) configured in the above manner as that of the first embodiment is provided in the supply port 32Y1.

Similarly to the first embodiment, the shutter mechanism in the second embodiment is also configured so that the shutter 39 opens or closes the supply port 32Y1 in conjunction with the relative attaching/detaching operation of the developing device 5Y (second device) to/from the toner container 32Y (first device). Furthermore, a guide groove (not shown) for guiding an opening/closing operation of the shutter 39 and an elastic member (not shown) for sealing a space formed with the shutter 39 in the state of the supply port 32Y1 being opened are provided in the toner container 32Y.

In the shutter mechanism according to the second embodiment similarly to the first embodiment, a space is formed between the guide groove of the shutter 39 and the end portion of the supply port 32Y1 contacted with the shutter 39 when the supply port 32Y1 is closed.

Furthermore, the elastic member is structured to deform in conjunction with an opening operation when the shutter 39 opens the supply port 32Y1 to cover the front end portion of the shutter 39.

As explained above, in the second embodiment, the guide groove for guiding the opening/closing operation of the shutter 39 and the structure of the elastic member provided between the shutter 39 in the state of the supply port 32Y1 being opened and the toner container 32Y (first device) are optimized. Therefore, with a comparatively simple configuration, high sealing capability is provided to the supply port 32Y1 through which toner (powder) is supplied from the toner container 32Y to the developing device 5Y (second device), so that the opening/closing operation of the shutter 39 is not failed or the sealing capability is not decreased even when the opening/closing operation thereof is repeated.

A third embodiment of the present invention will be explained in detail below with reference to FIG. 13.

Figure 13:
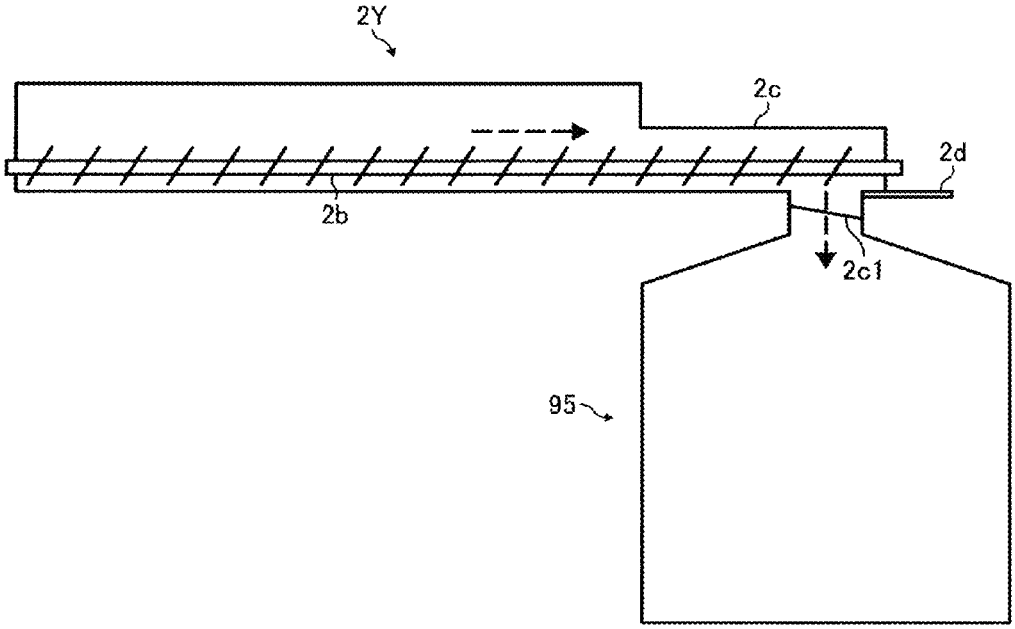
FIG. 13 is a schematic of a shutter mechanism according to a third embodiment of the present invention.

FIG. 13 is a schematic of a shutter mechanism according to the third embodiment. The shutter mechanism according to the third embodiment is different from the first embodiment in a point that the shutter mechanism in the third embodiment is provided in a supply port 2*c*1 of the cleaning unit 2Y (cleaning device) connected to a collection container 95, unlike the shutter mechanism that is provided in the supply port 80*a* of the toner supply device 59Y connected to the developing device 5Y according to the first embodiment.

An image forming apparatus according to the third embodiment is configured to collect used toner (waste toner) collected by the cleaning unit 2Y into the collection container 95. Specifically, a waste-toner conveying unit 2*c* that includes a conveyor screw 2*b* is provided in the cleaning unit 2Y. Provided in the waste-toner conveying unit 2*c* is the supply port 2*c*1 to supply toner to the collection container 95 (second device) connected to the cleaning unit 2Y or the body of the image forming apparatus (first device). Furthermore, a shutter mechanism (a shutter 2*d*) configured in the same manner as that of the first embodiment is provided in the supply port 2*c*1.

The shutter mechanism in the third embodiment is configured, similarly to the first embodiment, so that the shutter 2*d* opens or closes the supply port 2*c*1 in conjunction with the relative opening/closing operation of the collection container 95 (second device) to/from the cleaning unit 2Y (first device). Furthermore, a guide groove (not shown) for guiding an opening/closing operation of the shutter 2*d* and an elastic member (not shown) for sealing a space formed with the shutter 2*d* in the state of the supply port 2*c*1 being opened are provided in the waste-toner conveying unit 2*c*.

In the shutter mechanism in the third embodiment, similarly to the first embodiment, a space is also formed between the guide groove of the shutter 2*d* and the end portion of the supply port 2*c*1 contacted with the shutter 2*d* when the supply port 2*c*1 is closed.

Furthermore, the elastic member is structured to deform in conjunction with an opening operation when the shutter 2*d* opens the supply port 2*c*1 to cover the front end portion of the shutter 2*d*.

As explained above, in the third embodiment, the guide groove for guiding the opening/closing operation of the shutter 2*d* and the structure of the elastic member provided between the shutter 2*d* in the state of the supply port 2*c*1 being opened and the cleaning unit 2Y (first device) are optimized. Therefore, with a comparatively simple configuration, high sealing capability is provided to the supply port 2*c*1 through which toner (powder) is supplied from the cleaning unit 2Y to the collection container 95 (second device), so that the opening/closing operation of the shutter 2*d* is not failed or the sealing capability is not decreased even when the opening/closing operation thereof is repeated.

A fourth embodiment of the present invention will be explained in detail below in reference with FIGS. 14 to 18.

Figure 14:
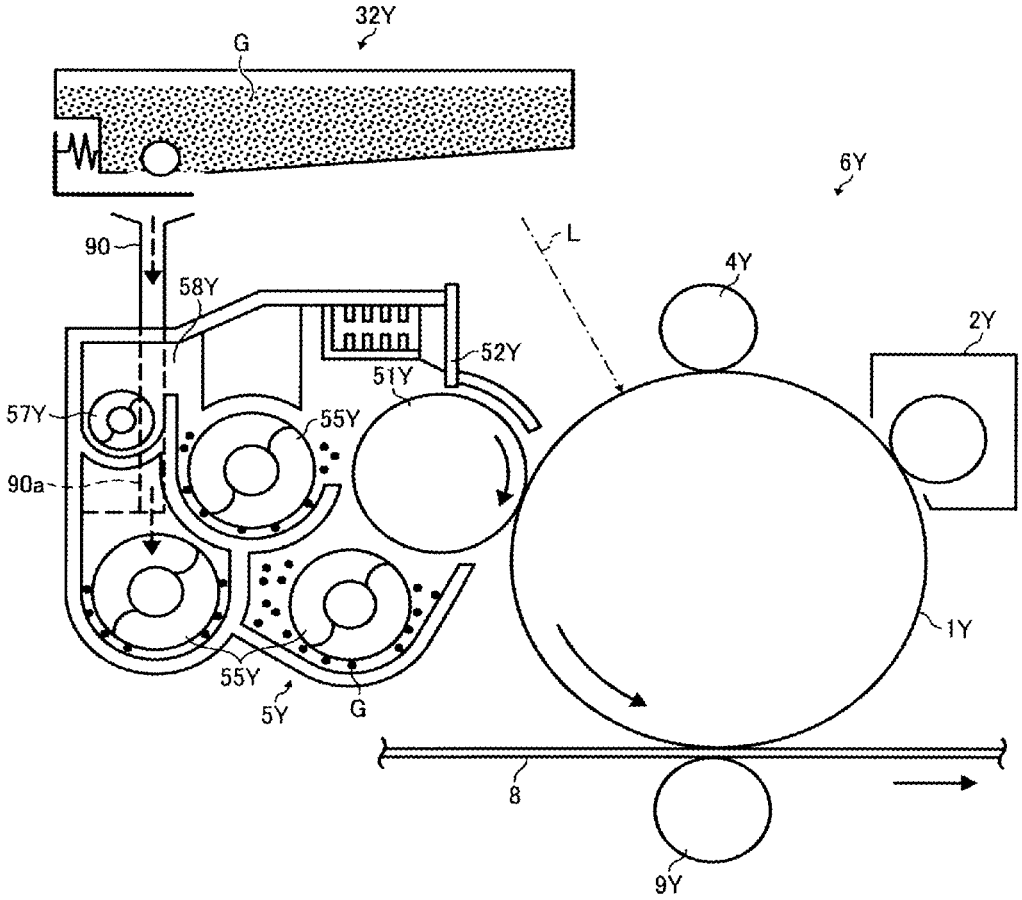
FIG. 14 is a schematic of a portion near a developing device according to a fourth embodiment of the present invention.
Figure 15:
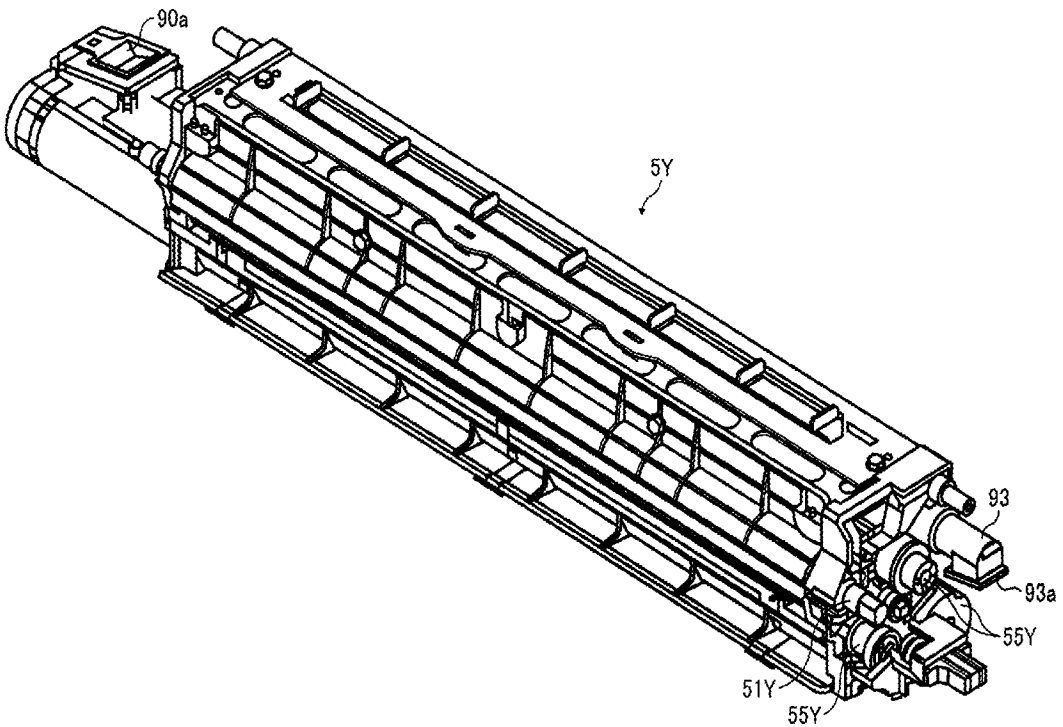
FIG. 15 is a perspective view of the developing device of FIG. 14.
Figure 16:
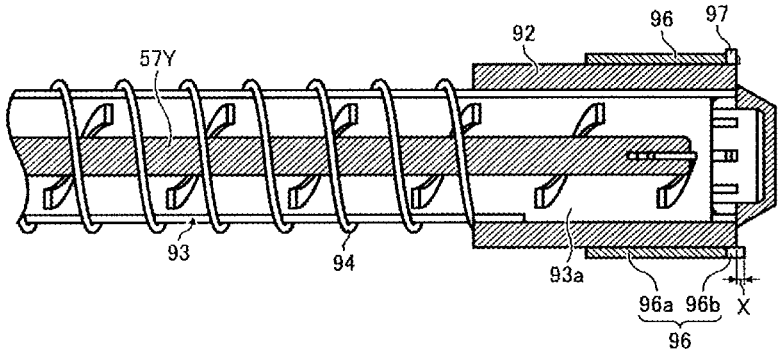
FIG. 16 is a cross section of a shutter mechanism of the developing device of FIG. 14.
Figure 17:
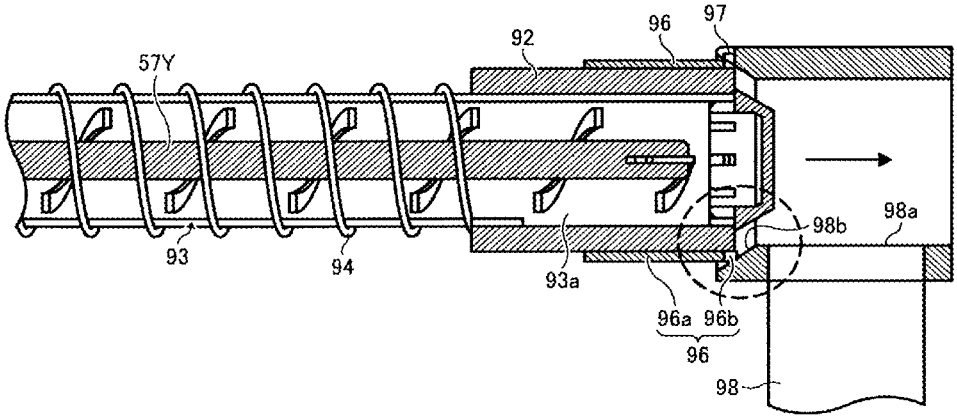
FIG. 17 is a schematic of how the shutter mechanism of FIG. 16 is connected to a collecting unit.
Figure 18:
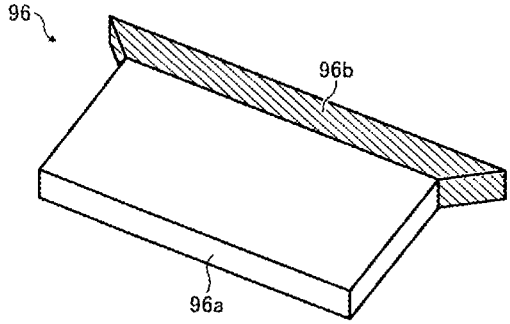
FIG. 18 is a perspective view of an elastic member in another shape.

FIG. 14 is a schematic of a portion near a developing device according to the fourth embodiment, and FIG. 15 is a perspective view of the developing device of FIG. 14. FIG. 16 is a cross section of a shutter mechanism of the developing device of FIG. 14. FIG. 17 is a schematic of how the shutter mechanism of FIG. 16 is connected to a collecting unit. FIG. 18 is a perspective view of an elastic member 96 in another shape.

The shutter mechanism according to the fourth embodiment is mainly different from the first embodiment in that the shutter mechanism is provided in a discharge pipe 93 of the developing device 5Y that supplies and discharges a developer and that a shutter 92 covers the discharge pipe 93.

Referring to FIGS. 14 and 15, the developing device 5Y according to the fourth embodiment includes the developing roller 51Y, the doctor blade 52Y, three (first, second, and third) conveyor screws 55Y, and a discharging conveyor screw 57Y.

The three conveyor screws 55Y agitate and mix the developer G contained in the developing device 5Y while circulating it in the longitudinal direction (direction perpendicular to the paper plane of FIG. 14).

The first conveyor screw 55Y is placed in a position opposed to the developing roller 51Y, horizontally conveys the developer G in the longitudinal direction (rotating axis direction), and supplies the developer G to the developing roller 51Y.

The second conveyor screw 55Y is placed in a position below the first conveyor screw 55Y and opposed to the developing roller 51Y. The second conveyor screw 55Y horizontally conveys the developer G separated from the developing roller 51Y in the longitudinal direction. Specifically, the developer G is forcibly separated from the developing roller 51Y by a developer separation pole after the developing process is finished.

The third conveying screw 55Y is placed in a position adjacent to the second conveyor screw 55Y and diagonally below the first conveyor screw 55Y. The third conveying screw 55Y conveys the developer G conveyed by the second conveyor screw 55Y, to the upstream side of a conveying path for the first conveyor screw 55Y and also conveys the developer G that circulates from the downstream side of the conveying path for the first conveyor screw 55Y, through an interchange portion, to the upstream side of the conveying path for the first conveyor screw 55Y.

The conveying path for the first conveyor screw 55Y, the conveying path for the second conveyor screw 55Y, a conveying path for the third conveyor screw 55Y, and a discharging conveying path for the discharging conveyor screw 57Y are partitioned from each other by partition walls.

The downstream side of the conveying path for the second conveyor screw 55Y and the upstream side of the conveying path for the third conveying screw 55Y communicate with each other through an interchange portion (not shown). Further, the downstream side of the conveying path for the first conveyor screw 55Y and the upstream side of the conveying path for the third conveying screw 55Y communicate with each other through an interchange portion (not shown). Moreover, the downstream side of the conveying path for the third conveyor screw 55Y and the upstream side of the conveying path for the first conveying screw 55Y communicate with each other through an interchange portion (not shown). The developer G stacked and banked up near the interchange portion in the conveying path for the third conveying screw 55Y is conveyed (supplied) to the upstream side of the conveying path for the first conveyor screw 55Y through the interchange portion.

This configuration allows formation of a circulating path in which the three conveyor screws 55Y circulate the developer G in the longitudinal direction in the developing device 5Y.

Here, a supply port 90*a* is provided in the upper side in the upstream side of the conveying path for the third conveying screw 55Y. A new developer G is then supplied from the toner (developer) container 32Y that contains the new developer G into the developing device 5Y as required through a conveying pipe 90.

A discharge port 58Y that discharges part of the developer G contained in the developing device 5Y to the outside of the conveying path is provided in a partition wall of the conveying path for the first conveyor screw 55Y.

Specifically, when the developer G is supplied from the developer container 32Y into the developing device 5Y, and when the amount of developer thereby increases in the developing device 5Y and a level (surface) of the developer conveyed to the developing device 5Y exceeds a predetermined height, then the discharge port 58Y is used to discharge the excessive developer G toward the discharge pipe 93 in which the discharging conveyor screw 57Y is placed. The developer discharged from the discharge port 58Y is conveyed by the discharging conveyor screw 57Y in the longitudinal direction (right direction of FIG. 15), falls under its own weight from a supply port 93*a* (98*a*) for discharging, and is collected in a developer storage container (not shown) being the collecting unit through a discharge path 98 provided outside the developing device (see FIG. 17). More specifically, the excessive developer G goes over the height of the lower part of the discharge port 58Y, is discharged from the discharge port 58Y, and is conveyed toward the developer storage container through the discharge pipe 93 (discharging conveyor screw 57) and the discharge path 98. The carrier contaminated and degraded by a matrix resin of toner and external additives is automatically discharged to the outside of the developing device 5Y, and this enables degradation of image quality with the passage of time to be minimized.

Referring to FIG. 16, the supply port 93*a* is provided in the discharge pipe 93 of the developing device 5Y (first device). Specifically, the supply port 93*a* is used to supply the developer (powder) to the developer storage container (second device) as the collecting unit. Also provided in the discharge pipe 93 is the shutter 92 that opens or closes the supply port 93*a* in conjunction with an attaching/detaching operation of the discharge pipe 93 to/from the discharge path 98 to cover the discharge pipe. Specifically, referring to FIG. 17, when the discharge pipe 93 is moved toward a head region of the discharge path 98 (moved in the arrow direction of FIG. 17), an engaging portion 97 provided in the shutter 92 comes in contact with the head region of the discharge path 98, so that the movement of the shutter 92 is restricted. By further moving the discharge pipe 93 in the arrow direction, the shutter 92 opens the supply port 93*a* to resist the force of a spring 94, and the supply port 93*a* of the discharge pipe 93 and the supply port 98*a* of the discharge path 98 are fitted to each other, and thus a connection between the both components 5Y and 98 is completed.

In the fourth embodiment, the elastic member 96 (sealing member) made of foamed polyurethane or the like is provided on (adhered to) a circumferential surface of the shutter 92. The elastic member 96 is used to seal between the discharge path 98 (second device) and the shutter 92 in the state of the supply port 93*a* being opened. This enables to prevent toner leakage from between the shutter 92 (discharge pipe 93) and the discharge path 98 when the shutter 92 is located at the open position.

A non-adhesive portion 96*b* that is not adhered to the shutter 92 is formed in the front end portion (the side close to the discharge path 98) of the elastic member 96. That is, only an adhesive portion 96*a* as an adherend surface of the elastic member 96 is adhered to the shutter 92. Referring to FIG. 17, when the shutter 92 opens the supply port 93*a*, the non-adhesive portion 96*b* comes in contact with the discharge path 98 in conjunction with the opening operation and deforms.

Thus, the toner is difficult to adhere to the front end portion of the shutter 92 (front end portion of the elastic member 96) even when the opening/closing operation of the shutter 92 is repeated. Therefore, the toner firmly fixed to the front end portion of the shutter 92 is minimized and the opening/closing operation of the shutter 92 is thereby smoothly performed, which enables to prevent toner supply (discharge) failure and toner scattering due to improper opening/closing operation of the shutter 92.

Here, referring to FIG. 16, the shutter mechanism according to the fourth embodiment is formed so that the non-adhesive portion 96*b* of the elastic member 96 is protruded from the front end portion (the side close to the discharge path 98) of the shutter 92. Specifically, the non-adhesive portion 96*b* is formed to protrude from the front end portion of the shutter 92 by 2 millimeters to 4 millimeters. That is, a protruded amount X of the non-adhesive portion 96*b* from the front end portion of the shutter 92 is set to 2 millimeters to 4 millimeters.

With this configuration, when the shutter 92 opens the supply port 93*a*, the non-adhesive portion 96*b* comes in contact with the discharge path 98 in conjunction with the opening operation, to be easily deformed to cover the front end portion of the shutter 92. Therefore, it is possible to reliably prevent toner leakage from between the shutter 92 (discharge pipe 93) and the discharge path 98.

Further, by protruding the non-adhesive portion 96*b* from the front end portion of the shutter 92, when the shutter 92 closes the supply port 93*a*, toner falling from the front end portion of the shutter 92 can be caught by a protrusion (a range of X in FIG. 16) of the non-adhesive portion 96*b*. Therefore, it is possible to reduce toner scattering in the apparatus body 100 occurring with the opening/closing operation of the shutter 92.

When the protruded amount X of the non-adhesive portion 96*b* from the front end portion of the shutter 92 is smaller than 2 millimeters, the non-adhesive portion 96*b* is less deformed, while the protruded amount X is larger than 4 millimeters, the non-adhesive portion 96*b* may deform in a reverse direction (to the central axis side of the discharge pipe 93). Therefore, to surely obtain the effect, the protruded amount X of the non-adhesive portion 96*b* from the front end portion of the shutter 92 is set to a range of 2 millimeters to 4 millimeters.

Referring to FIG. 17, in the shutter mechanism of the fourth embodiment, a portion (surrounded by a dotted line in FIG. 17), which is contacted with the non-adhesive portion 96*b* of the elastic member 96, in the head region of the discharge path 98 (second device) is tapered. Specifically, a tapered portion 98*b* is formed in the head region of the discharge path 98 in such a manner that a diameter of an insertion port, into which the discharge pipe 93 is inserted, is tapered in an insertion direction (right direction in FIG. 17).

With this configuration, even when the discharge pipe 93 is inaccurately inserted into the head region of the discharge path 98 (the central axes of the components 93 and 98 are displaced from each other), the non-adhesive portion 96*b* of the elastic member 96 contacts the tapered portion 98*b* of the discharge path 98 without fail. Thus, the elastic member 96 deforms to cover the front end portion of the shutter 92, which enables to surely prevent toner leakage from between the shutter 92 (discharge pipe 93) and the discharge path 98.

Referring to FIG. 18, in the shutter mechanism according to the fourth embodiment, the non-adhesive portion 96*b* of the elastic member 96 is preferably formed in such a manner that the width of the non-adhesive portion 96*b* is wider in the front end direction (which is a direction away from the adhesive portion 96*a* and close to the discharge path 98).

With this configuration, when the non-adhesive portion 96*b* comes in contact with the discharge path 98 and deforms to cover the front end portion of the shutter 92, the front end of the non-adhesive portion 96*b* easily deforms to cover the circumferential surface of the cylindrical shutter 92. Thus, it is possible to further surely prevent toner leakage from between the shutter 92 (discharge pipe 93) and the discharge path 98.

In the fourth embodiment, the present invention is applied to the shutter mechanism provided in the discharge pipe 93 of the developing device 5Y, however, the present invention is also applicable to the shutter mechanism that is provided in the supply port 2*c*1 of the cleaning unit 2Y (cleaning device) connected to the collection container 95 (collecting unit). In this case, the developing device 5Y and the cleaning device 2Y can be provided as a process cartridge.

As explained above, in the fourth embodiment, with a comparatively simple configuration, high sealing capability is provided to the supply port 93*a* through which the developer (powder) is supplied from the discharge pipe 93 of the developing device 5Y (first device) toward the collecting unit 95 (second device), so that the opening/closing operation of the shutter 92 is not failed or the sealing capability is not decreased even when the opening/closing operation thereof is repeated.

It is obvious that the present invention is not limited to the embodiments and that the embodiments can be changed if necessary in the scope of the technological idea of the present invention other than suggestion of the embodiments. The number, the positions, and the shapes of components are not limited to these of the embodiments, and thus, these can be changed to any number, position, and shape that are appropriate for implementation of the present invention.

According to one aspect of the present invention, the guide groove for guiding the opening/closing operation of the shutter and the structure of the elastic member provided between the shutter in the state of the supply port being opened and the first device are optimized. Thus, it is possible to provide the shutter mechanism, the powder supply device, and the image forming apparatus with a comparatively simple configuration having high sealing capability of the supply port through which the powder is supplied from the first device toward the second device and being free from opening/closing failure of the shutter or without decrease in sealing capability even when the opening/closing operation of the shutter is repeated.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A shutter mechanism provided in a supply port through which powder is supplied to a second device from a first device, the shutter mechanism comprising:

a shutter that opens and closes the supply port in conjunction with attaching and detaching operation of the second device with respect to the first device; and a guide groove that is provided in a recess manner so as not to be exposed from the supply port as viewed from the second device and guides the opening and closing operation of the shutter, the guide groove being outside of a housing of the first device and outside a housing of the second device, wherein a space is formed between the guide groove and an end portion of the supply port making contact with the shutter when the shutter closes the supply port.

2. The shutter mechanism according to claim 1, wherein a sealing member is provided in the end portion of the supply port.

3. The shutter mechanism according to claim 1, wherein the shutter includes an engaging unit that engages with the second device in conjunction with the attaching and detaching operation of the second device with respect to the first device at each of side portions of the shutter in its width direction perpendicular to a direction of attaching the second device.

4. An image forming apparatus comprising a shutter mechanism according to claim 1.

5. A shutter mechanism provided in a supply port through which powder is supplied to a second device from a first device, the shutter mechanism comprising:

a shutter that opens and closes the supply port in conjunction with attaching and detaching operation of the second device with respect to the first device;

a guide groove that is provided in a recess manner so as not to be exposed from the supply port as viewed from the second device and guides the opening and closing operation of the shutter, the guide groove being outside of a housing of the first device and outside a housing of the second device; and an elastic member provided in the first device to seal a space formed with the shutter in a state of opening the supply port, wherein when the shutter opens the supply port, the elastic member deforms in conjunction with the opening operation to cover a front end portion of the shutter.

6. The shutter mechanism according to claim 5, wherein the elastic member includes a non-adhesive portion that is not adhered to the first device, and when the shutter opens the supply port, the non-adhesive portion deforms in conjunction with the opening operation to cover the front end portion of the shutter.

7. The shutter mechanism according to claim 6, wherein the elastic member is formed so that the non-adhesive portion protrudes from the front end portion of the shutter.

8. The shutter mechanism according to claim 5, wherein the non-adhesive portion is formed in a tapered manner in width to be wider in its front end direction.

9. The shutter mechanism according to claim 5, wherein the shutter rotates so that the front end portion of the shutter embeds itself in part of the elastic member when the shutter opens the supply port.

10. The shutter mechanism according to claim 9, further comprising a biasing member that biases the shutter in a direction of closing the supply port, wherein the shutter rotates by a rotational moment caused by a biasing force from the biasing member and a force to act against the biasing force when the shutter opens the supply port.

11. The shutter mechanism according to claim 5, wherein the elastic member includes a low-friction element provided in a plane opposed to the shutter that is a position other than a position in which the front end portion of the shutter is covered.

12. The shutter mechanism according to claim 5, wherein the first device includes a guide portion provided with the elastic member, the guide portion guiding an opening operation of the shutter when the shutter opens the supply port.

13. The shutter mechanism according to claim 5, wherein the shutter includes an engaging unit that engages with the second device in conjunction with the attaching and detaching operation of the second device with respect to the first device at each of side portions of the shutter in its width direction perpendicular to a direction of attaching the second device.

14. An image forming apparatus comprising a shutter mechanism according to claim 5.

15. A shutter mechanism provided in a supply port through which powder is supplied to a second device from a first device, the shutter mechanism comprising:

a shutter that opens and closes the supply port in conjunction with attaching and detaching operation of the second device with respect to the first device; and an elastic member provided in the first device to seal a space formed with the shutter in a state of opening the supply port, the elastic member in contact with a back surface of the shutter and an end portion of the elastic member wrapping around an edge of the shutter to contact an end surface of the shutter, wherein the end portion of the elastic member includes a non-adhesive portion that is not adhered to the first device, and when the shutter opens the supply port, the non-adhesive portion deforms in conjunction with the opening operation to cover the front end portion of the shutter.

16. The shutter mechanism according to claim 15, wherein the elastic member is formed so that the non-adhesive portion protrudes from the front end portion of the shutter.

17. The shutter mechanism according to claim 15, wherein the non-adhesive portion is formed in a tapered manner in width to be wider in its front end direction.

18. The shutter mechanism according to claim 15, wherein a portion of the second device making contact with the non-adhesive portion is formed in a tapered manner.

19. The shutter mechanism according to claim 15, wherein the shutter includes an engaging unit that engages with the second device in conjunction with the attaching and detaching operation of the second device with respect to the first device at each of side portions of the shutter in its width direction perpendicular to a direction of attaching the second device.

20. An image forming apparatus comprising a shutter mechanism according to claim 15.

* * * * *